United States Patent [19]

Chace

[11] Patent Number: 4,792,974

[45] Date of Patent: Dec. 20, 1988

[54] AUTOMATED STEREO SYNTHESIZER FOR AUDIOVISUAL PROGRAMS

[76] Inventor: Frederic I. Chace, 1746 N. Courtney, Los Angeles, Calif. 90046

[21] Appl. No.: 89,507

[22] Filed: Aug. 26, 1987

[51] Int. Cl.[4] ..... H04S 1/00

[52] U.S. Cl. ..... 381/1; 358/341; 358/343; 360/19.1; 369/87; 381/17

[58] Field of Search ..... 358/341, 342, 343; 360/19.1, 14.1; 369/87, 89, 92; 381/1, 17, 18

[56] References Cited

U.S. PATENT DOCUMENTS

| | | | |
|---|---|---|---|
| 3,217,080 | 11/1965 | Clark, Jr. . | |
| 3,670,106 | 6/1972 | Orban . | |
| 4,067,049 | 1/1978 | Kelly et al. | 360/14.1 |
| 4,188,504 | 2/1980 | Kasuga et al. . | |
| 4,329,544 | 5/1982 | Yamada | 381/86 |
| 4,388,654 | 6/1983 | Mehrotra | 358/343 |
| 4,394,536 | 7/1983 | Shima et al. . | |
| 4,399,329 | 8/1983 | Wharton | 358/341 |
| 4,433,347 | 2/1984 | Sugiyama et al. | 358/342 |
| 4,489,439 | 12/1984 | Scholze et al. | 381/63 |
| 4,503,471 | 3/1985 | Hanajima et al. | 360/65 |
| 4,523,236 | 6/1985 | Hayashi et al. | 358/341 |
| 4,564,867 | 1/1986 | Nakajima | 358/343 |
| 4,583,132 | 4/1986 | Nakano et al. | 358/341 |
| 4,598,324 | 1/1986 | Efron et al. | 358/341 |
| 4,706,287 | 11/1987 | Blackmer et al. | 381/17 |

*Primary Examiner*—Forester W. Isen

*Attorney, Agent, or Firm*—Fulwider, Patton, Rieber, Lee & Utecht

[57] ABSTRACT

Surround stereo signals are synthesized from the composite or DME monaural sound tracks of audiovisual programs by use of multi-channel, computer-controlled digital circuitry and operator-programmed sound cues, the latter matching video time codes with audio control signals. The stereo signals have out-of-phase delay components, resulting in compatibility with conventional monaural audio equipment, and steerable pan components, resulting in selective sound placement capacity. Variable time delays and variable ratios of dry and delay are used in conjunction with panning movements to achieve a wide variety of acoustical effects, such as resonance, spread and cutting, which correlate the audio portion of the program with the video portion of the program. An operator selects and programs sound cues and stores them for playback by using a plurality of audio controls and a computer interface which are provided on an operator console. Subroutines are used for automated cue recording and for editing. Stereo sound tracks are created from monaural source material.

41 Claims, 4 Drawing Sheets

AUTOMATED STEREO SYNTHESIZER FOR AUDIOVISUAL PROGRAMS

BACKGROUND OF THE INVENTION

This invention relates generally to stereo synthesizers and, more particularly, has reference to a new and improved method and apparatus for converting the monaural audio tracks of audiovisual programs into surround stereo signal which are mono-compatible and steerable and which are synchronized with the video portion of the program.

In early movies and television programs, all of the sound elements in the audio portion of the program (i.e., dialogue, music and effects) were combined into a composite monaural signal which was recorded onto a single optical sound track. On playback, the optical track was scanned by a reader which recovered the composite monaural signal and fed the signal into the input of a monaural sound system.

Later fllms, taking advantage of magnetic tape recording techniques, used magnetic sound tracks. These tracks often had less surface noise (e.g., clicks and pops) and less distortion than optical tracks, but they generally continued to employ a composite monaural signal which was designed to be played through a monaural sound system.

An audiovisual program with a monaural sound track tends to lack realism. The sound remains stationary despite the fact that the sound elements may be moving around in the visual field. Stereo sound is generally regarded as more realistic and more pleasing to the ear because the sound can be moved around and placed in the sound field where it appears in the video picture. For example, the sound of a siren can be moved from left-to-right in the sound field as a police car speeds across the screen.

It would be highly desirable to produce movies and other audiovisual programs with true stereo sound tracks. Unfortunately, many early attempts to record stereo movies were not entirely satisfactory. The microphone array used for recording was often heavy and caused shadows. Post-production and dialogue replacement was often difficult. The process tended to be expensive and there were certain technical difficulties in producing consistent stereo scene-to-scene.

The continuing desire for stereo sound led to the development of so-called stereo synthesizers. These devices were passive "boxes" which received the output from a monaural audio source and purported to convert the composite monaura signal into a pseudo-stereo signal.

Conventional synthesizers fell into three general categories. The first used a comb filter to separate the monaural signal into alternating frequency bands and then placed the alternate bands into respective left and right channels. The second category used a time delay in which the monaural signal was separated into two channels with one of the channels being delayed by some time period. The third category combined a time delay and a comb filter.

These types of stereo synthesizers produced a stationary sound field in which the monaural sound was simply spread out in some fixed manner. The listener became accustomed to this fixed field and did not perceive any of the left-to-right or front-to-back movement of a sound which is characteristic of a stereo system.

Delay-type synthesizers also had a tendency to produce an echo in the audio program when the synthesizer channels were mixed together This could be a problem in applications such as television broadcasting and home video where it is often desirable to restore the original monaural signal for playback through the monaural sound system of a conventional television receiver.

Stereo synthesizers and other types of devices which alter audio signals have been known for a number of years, and by way of example, several forms of such devices can be found in U.S. Pat. Nos. 4,489,439 (Scholz et al.), 3,670,106 (Orban), 4,188,504 (Kasuga et al.), 4,394,536 (Schima et al.), 3,217,080 (Clark) and 4,329,544 (Yamada).

There was recently a proposal for a new type of television sound system in which mono dialogue, mono music and panned effects were used to simulate a stereo sound. The system had some steering compatibility, i.e., the ability to move a sound around and place it in the sound field where it belongs, but the system operated with a multitrack audio source having separate monaural tracks for dialogue, music and effects. This "DME" source created problems of compatibility with the great numbers of audio programs which used a composite sound track. Moreover, the system left considerable room for improvement in creating convincing stereo-like sound which the ear would perceive.

When a stereo synthesizer is used with an audiovisual program, it is obviously desirable to produce a stereo sound which is well synchronized with the video program. The sound elements should change and move throughout the sound field as the corresponding visual elements change and move throughout the video field. Existing systems have not been entirely satisfactory in this respect. Passive stereo synthesizers derive sound fields from monaural audio signals which contain little or no video information. Certain active stereo synthesizers have accepted user input of video information but they operated manually. The user had to turn dials or the like to effect changes in the audio signals while the video program was being run in real time. With such a system, it was difficult to accurately synchronize the audio signal with the video program, particularly where the video program required rapid or complex changes in the sounds.

Accordingly, a need exists for a stereo synthesizer which can produce a steerable surround stereo signal from a composite or separate monaural sound tracks used in audiovisual programs, which can automatically maneuver the sound signal left-to-right or front-to-back in the sound field in a manner which is well-synchronized with the movement of the corresponding visual elements in the program, and which can restore the program's original monaural signal for broadcast or playback through a conventional monaural sound system. The present invention fulfills all of these needs.

SUMMARY OF THE INVENTION

Briefly, and in general terms, the present invention provides a new and improved method and apparatus for creating a mono-compatible and steerable surround stereo signal from a single track or multiple track monaural audiovisual program by using computer-controlled digital circuitry, video time codes and operator-programmed sound cues. The result is realistic post-production stereo sound which is well synchronized with the video program and which obviates the expense and technical difficulties of stereo recording.

In a presently preferred embodiment, by way of example and not necessarily by way of limitation, the monaural signal from the audio track is fed into a computer-controlled audio processing unit where it is divided into three substantially identical monaural signals. Two of the signals are processed similarly by digital delay circuitry which adds a variable time delay to the signal and by level control circuitry which varies the amplitude of the delayed signal which is mixed with the undelayed or "dry" monaural signal. The third signal is processed by pan and pan width control circuitry which uses voltage-controlled amplifiers to produce pan left and pan right signals. The delay signals and the pan signals are combined with a mono summation signal in a combining matrix circuit. The matrix output includes left channel and right channel stereo output signals with encoded surround information.

The audio processing unit has three separate channels for separately processing the dialogue track, the music track and the effects track of a multitrack DME source. In the case of a single track source, the monaural signal is fed into the dialogue channel (which is then conveniently called the composite mono channel) and the other two channels are not used. The mono summation signal fed into the combining matrix is a summation of the separate channel inputs.

Sound cues which are used to create the stereo output signals are programmed into the memory of the processing unit computer by an operator who sits at a console and steps through the video program. The console has a keyboard which is used to give commands to computer programs and subroutines which are stored in the computer. The console also has a plurality of dials (called "pots") which manually operate potentiometers that control the delay, level, pan and pan width circuits in the audio processing unit.

The delay pots affect the resonance of the sound. The level pots affect the width or spread of the sound field and the pan pots move the sound left and right in the sound field. By turning individual pots or groups of pots in a prescribed manner, the operator can achieve a wide variety of acoustical effects, including the selective steering of the sound elements left-to-right or front-to-back in the sound field, even with a composite monaural source.

The operator adjusts the pots until he obtains the acoustical effects which best match the sound to the scene under observation. For example, he can cause the dialogue from a stationary actor to remain center screen while the siren behind him moves left-to-right. When the appropriate pot settings are found, the operator commands the computer to store the settings in memory along with codes which identify the corresponding video frames. In the preferred embodiment of the invention, the code is the well-known SMPTE time code which is used with certain types of audiovisual source material such as video cassette tapes. The SMPTE system assigns a separate code number to each video frame to indicate the sequential position of the frame and the time when the frame appears on the screen.

The sound cues can be recorded manually on a frame-by-frame basis or they can be recorded in an automated fashion by use of certain subroutine functions programmed into the computer. A DYNAMIC function is used to automatically perform a linear move between the instant cue and a previous cue. A CONTINUOUS POT RECORDING function is used to record a real-time pot movement exactly as it was done. A SOFT-KEY function is used to cause a prerecorded pot setting to be put into memory as a cue. An EDIT function allows cues to be changed or deleted after they have been stored in memory and also allows new cues to be inserted directly into memory.

In the playback mode, the audiovisual program is run in real time and the sound cues stored in memory are automatically recalled when a time code match is achieved. This time code automation process causes the computer to produce a series of output control voltages which regulate the audio processing circuits in accordance with the sequence of recalled sound cues. The acoustical effects which were programmed by the operator are thss recreated in real time in a manner which is synchronized with the video program. The sound follows the picture so that wherever a sound source appears on the screen, the corresponding sound can be located there in the sound field. The result is realistic stereo sound from a composite or multitrack monaural audio source.

Additional flexibility is provided by a WILD ADJUST function which can be used to intercept a control voltage dictated by a recalled cue and to substitute a new voltage dictated by the present manual setting of a pot. In other words, WILD ADJUST can be used override the programmed acoustical effects and substitute new acoustical effects which are dictated by the real-time pot settings.

In addition to creating a conventional left/right stereo signal, the present invention is also capable of converting a monaural audio signal into an encoded four channel center and surround signal which is compatible with the Dolby Surround playback equipment frequently found in theaters and consumer electronics products. When the delay pots and level pots are set to produce long or intense delays and the resulting stereo signal is fed into a standard Dolby decoder, the sound tends to be directed into the surround channel. This feature can be used to provide full stereo and surround for monaural programs which are released in theatres, home video and broadcast media.

The stereo signals produced by the present invention are also mono compatible. The combining matrix causes the delay signals which are added to the left channel to be 180° out-of-phase with the delay signals which are added to the right channel. When the two channels are mixed back together as would happen in television broadcasting or home video, the delay signals cancel each other out and the original mono signal is restored.

After the sound cues have been entered, the present invention can be used as a playback system to provide stereo sound from a monaural audiovisual program or it can be used as a post-production technique to create a recorded stereo sound track from a monaural program. Hence, the present invention is used to enhance an existing monaural program by providing it with stereo sound without the high cost and technical difficulties associated with recording in stereo.

These and other objects and advantages of the invention will become apparent from the following more detailed description, when taken in conjunction with the accompanying drawings of illustrative embodiments.

DETAILED DESCRIPTION OF THE PREFERRED EMBODIMENTS

Figure 1:
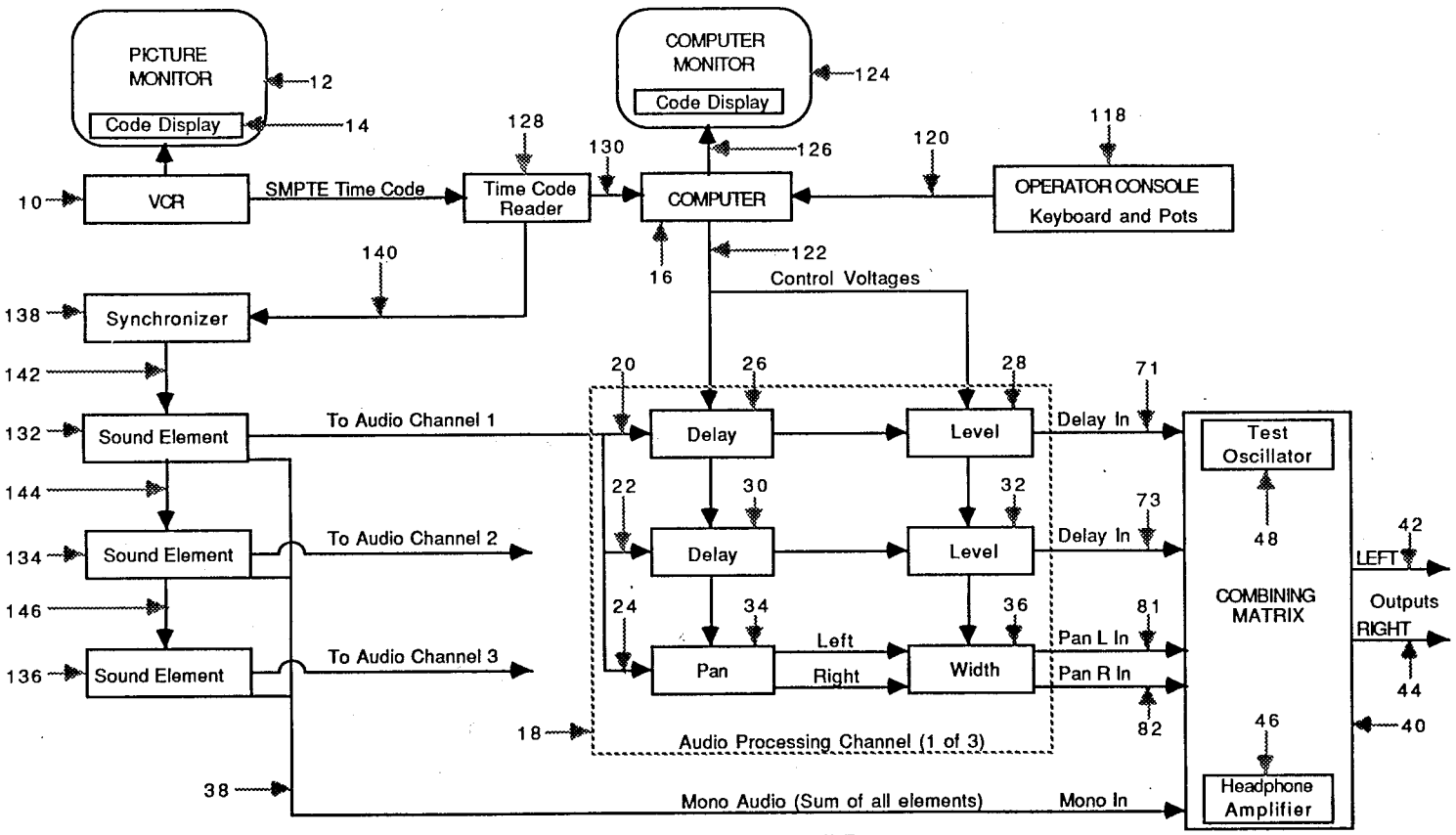
FIG. 1 is an overall block diagram of an automated stereo synthesizer embodying features of present invention.

As shown in the drawings for purposes of illustration, the invention is embodied in an operator-programmed, computer-controlled audio processing unit which produces surround stereo signals from the monaural audio track of an audiovisual program. The overall layout and operation of the equipment used for a preferred embodiment of the invention is best understood by reference to FIGS. 1-3.

A. Preferred Apparatus

Referring to FIG. 1, a conventional two channel, VITC-compatible, video cassette deck ("VCR") 10 is used to play a selected audiovisual program which has a monaural sound track. The VCR 10 preferably has a shuttle control which can be used to step through the video program one frame at a time. A suitable VCR is the JVC model CR850U.

When dealing with theater film and other audiovisual source material which are originated in a non-VCR format, the audio and video programs are first laid back onto a working tape which typically is a video cassette in a VCR format with SMPTE time code. A single audio channel of the working cassette is usually sufficient for a composite monaural sound track. For a DME sound track which normally uses both audio channels in the working cassette, the audio program is first conformed onto a multitrack audio tape matching the video The conformed DME track is then laid back onto the working cassette by placing the dialogue track onto one channel, the effects track onto the other channel, and the music track on both channels out-of-phase with each other and at about 10 db below its mono level.

A conventional television monitor 12 receives the video signals from the VCR 10 and displays the video program on the monitor display screen (not shown). The video time code is also displayed in a code display region 14 of the monitor screen. A suitable monitor is the Profeel video monitor manufactured by Sony.

The working cassette is played by the VCR 10 in order to program the sound cues. The exact nature of these sound cues and of the programming process will be described in detail later in this specification. Suffice it to say at this stage that the sound cues are a series of commands which are selected and programmed into a system computer 16 by an operator who watches the video program being displayed on the monitor 12. The preferred computer is the Apple II GS. These sound cues are used during a playback mode of operation to alter the signals which are produced by a monaural sound track and thus create stereo sound signals.

The monaural audio signal produced by the VCR 10 is fed into the input of an audio processing unit. In accordance with the present invention, the audio processing unit acts in concert with the system computer 16, the video time codes and the operator-programmed sound cues to create mono-compatible and steerable surround stereo signals from the monaural audio source which are well synchronized with the video program. The result is enhanced audio quality for the monaural audio program and a reduction in the expense and technicl difficulties associated with creating a stereo sound track.

The preferred audio processing unit has three substantially similar audio processing channels. For convenience, only one of these channels 18 is shown in FIG. 1.

For a composite monaural sound track, the audio signal from the VCR 10 is fed into only one of the audio processing channels (e.g., Audio Channel No. 1) which is then conveniently referred to as the composite mono channel. For a DME sound track, all three audio processing channels are used. The dialogue signal from the VCR 10 is fed into one of the channels (e.g., Audio Channel No. 1) which is then conveniently called the dialogue channel. The effects signal and the music signal are separately fed into the remaining two channels (e.g., Audio Channels No. 2 and Audio Channel No. 3) which are then conveniently referred to as the effects channel and the music channel, respectively.

Each audio processing channel 18 splits its respective input signal into three branches 20, 22 and 24. One of the branches 20 is processed by delay circuitry 26 and level control circuitry 28. The delay circuits 26 add a variable time delay to the signal while the level control circuitry 28 varies the amplitude of the delayed signal. The delay adds resonance to the sound. The amplitude of the delay controls the spaciousness or spread of the sound, i.e., it acoustically expands the sound to a wider field when it is increased and contracts the sound into a narrower field when it is decreased. This control over the spaciousness of the sound is achieved because the delayed signals are ultimately combined with the original or "dry" signals. The level control circuitry 26 thus regulates the amplitude ratio of dry and delay signals which are mixed together.

Another branch 22 of the audio processing channel 18 also processes the input signal by delay circuitry 30 and level control circuitry 32. Thes circuits are substantially similar in structure and function to the ones used in the aforementioned delay branch 20, the primary difference residing in the length of the time delay which is added to the signal. For the dialogue and the effects channels (in the case of a DME source), one of the delay circuits 26 preferably introduces a short duration delay which is selectively variable between about 2-8 ms. The other delay circuit 30 preferably introduces a medium duration delay which is selectively variable between about 8-32 ms. The delay circuits for the music channel introduce fixed delays of medium duration (preferably about 16 ms) and long duration (preferably about 64 ms), respectively. The composite mono channel preferably uses a short duration delay which is selectively variable between about 2-8 ms and a long duration delay which is selectively variable between about 32-128 ms.

The remaining branch 24 of the audio processing channel 18 is processed by pan and pan width control circuitry 34 and 36. Pan control 34 is used to selectively adjust the left and right placement of the sound in the sound field. Pan width control 36 is used to selectively adjust the width of the pans, i.e., the maximum range of left and right panning movement.

The processed signals from each of the three branches 20, 22 and 24 of each audio processing channel 18 are combined and mixed together with a mono summation signal 38 in a combining matrix 40. The mono summation signal 38 is formed by summing together all of the respective input signals which are fed into the three channels of the audio processing unit. In the case of a composite monaural source, the mono summation signal is identical to the input signal which is fed into the composite mono channel. The mixing which takes place in the combining matrix 40 produces left channel and right stereo output signals 42 and 44 which are mono compatible. In a preferred embodiment of the invention, the combining matrix 40 is provided with a mono test switch (not shown) which can be used to selectively combine the left and right channels 42 and 44 for periodically checking the integrity of the reconstituted mono signal and for test and alignment purposes.

The stereo output signals 42 and 44 produced by the combining matrix 40 are capable of carrying Dolby Surround information. Hence, in a preferred embodiment of the invention, the stereo signals 42 and 44 are fed into the input of a conventinnal Dolby Surround decoder (not shown), such as the Fosgate 360° Space Matix, which is set up to drive center and surround speakers (not shown). When the delay circuits 26 and 30 and level control circuits 28 and 32 are set to produce long or intense delays, the Dolby four-channel surround information which is encoded onto the stereo signals 42 and 44 tends to cause the sound to be directed into the surround channel. In an alternative embodiment of the invention, the stereo signals 42 and 44 are fed directly into the input of a conventional stereo amplifier (not shown) which drives conventional stereo speakers (not shown). A conventional stereo headphone amplifer 46 is built into the combining matrix 40 and is used to drive conventional stereo headphones (not shown) which may be worn by the operator to monitor the stereo signals 42 and 44.

In a preferred embodiment of the invention, the stereo signals 42 and 44 are also applied to the input of a conventional XY oscilloscope (not shown), such as the Kenwood CS 1575A. The left channel signal 42 is preferably applied to the vertical deflection input of the oscilloscope while the right channel signal 44 is preferably applied to the horizontal deflection input of the oscilloscope. The scope thus provides a two-dimensional visual image of the contour and placement of the stereo sound. This can be useful to the operator when he is selecting and adjusting the sound cues.

The preferred embodiment of the invention also includes a 400 Hz test oscillator 48 which is built into the combining matrix 40. The oscillator can be selectively activated to produce a +4 dbm test signal on both the left and right channel stereo outputs 42 and 44.

Figure 2:
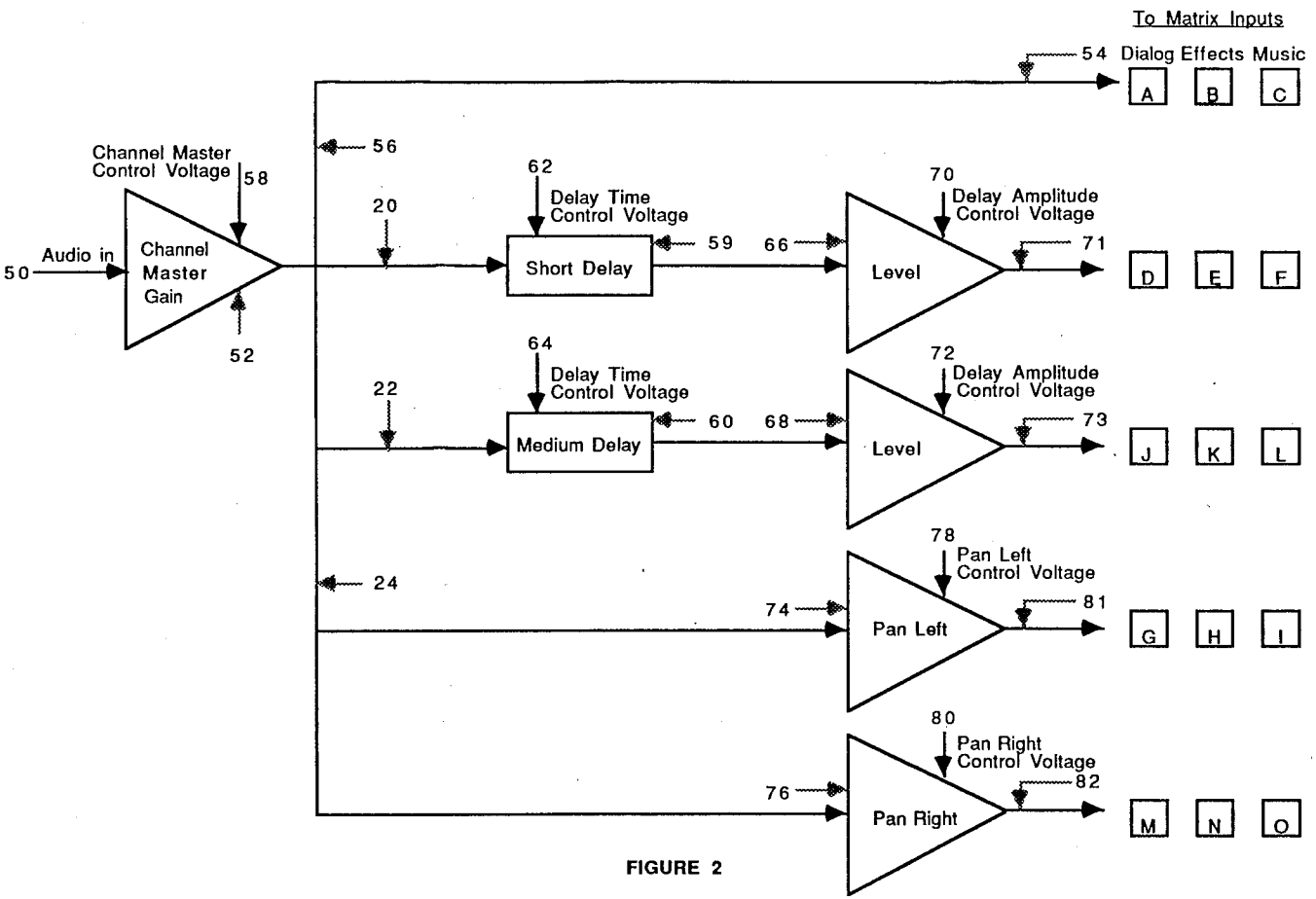
FIG. 2 is an electrical schematic diagram of one channel in an audio processing unit suitable for use in the synthesizer of FIG. 1.
Figure 3:
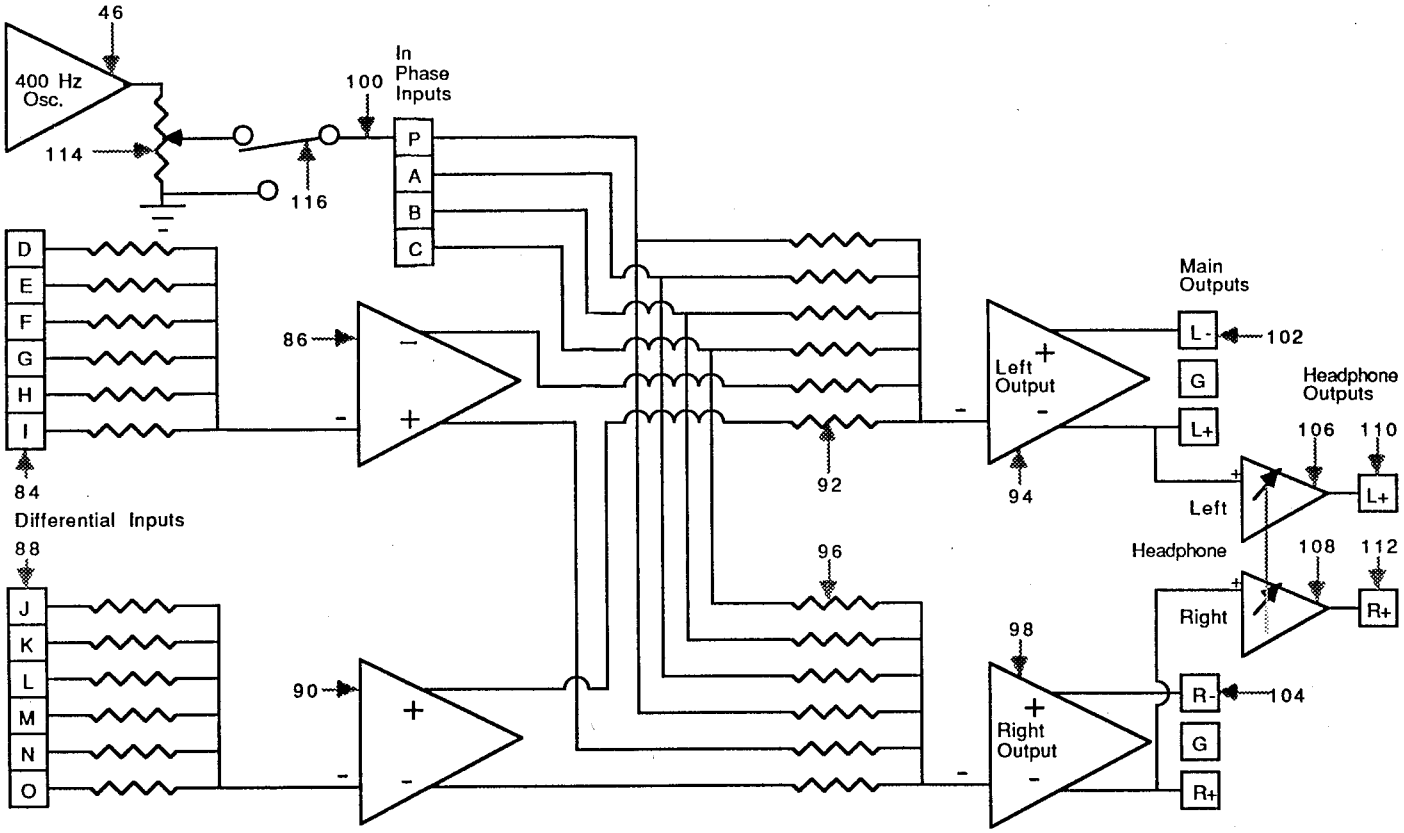
FIG. 3 is an electrical schematic diagram of a combining matrix suitable for use in the synthesizer of FIG. 1.

Details of the circuitry for the audio processing channel 18 and the combining matrix 40 are best understood by reference to FIGS. 2 and 3.

Referring to FIG. 2, which illustrates circuitry for one of the audio processing channels 18, the monaural input signal from the VCR 10 which is to be processed by that audio channel 18 is first fed over a line 50 into the input of a voltage-control master gain amplifier 52. The Model VCA 505 manufactured by Aphex is an example of an amplifier which is suitable for use as the master gain amplifier 52 or for use as any of the other amplifiers which are used in the audio processing unit.

The output of the master gain amplifier 52 feeds a first line 54 which contributes the channel input signal to the mono summation signal 38. It also feeds a second line 56 which passes the channel input signal to the three branches 20, 22 and 24 of the audio processing channel 18. By selectively varying the gains of the master gain amplifiers 52 in each of the audio channels 18, the respective channel input signals for dialogue, music and effects can be mixed together in varying proportions to form the mono summation signal 38. The gains of the master gain amplifiers 52 are controlled by channel master control voltages 58 which are supplied by the system computer 16.

The delay circuits 26 and 30 are provided by a pair of voltage-controlled time line digital delay units 59 and 60, such as the model PCM 41 manufactured by Lexicon, which are arranged to receive the input signals applied to the respective delay branches 20 and 22 of the audio processing channel 18. The delay units 59 and 60 are provided with range switches (not shown) which are used to manually set the range of delay which can be produced by the unit. Selection of a specific duration of delay within the set range is accomplished by varying delay time control voltages 62 and 64 which are applied to the respective units 59 and 60. The control voltages for the delay units are 59 and 60 are supplied by the computer 16.

The level control circuits 28 and 32 are provided by a pair of voltage-controlled amplifiers 66 and 68 which are arranged in series with the respective delay units 59 and 60 to receive the output signals therefrom. Delay amplitude control voltages 70 and 72 which regulate the gains of the level control amplifiers 66 and 68 are supplied by the computer 16. The outputs of the level control amplifiers 66 and 68 are fed over respective channel output lines 71 and 73 to provide delay signals to the combining matrix 40.

The pan and pan width control circuits 34 and 36 are provided by a pair of voltage-controlled amplifiers 74 and 76 which are arranged to receive the input signals applied to the pan branch 24 of the audio processing channel 18. The gains of these amplifiers 74 and 76 are regulated by respective pan left and pan right control voltages 78 and 80 which are supplied by the computer 16. The output of one of the amplifiers 74 is fed over a channel output line 81 to provide pan left signals to the combining matrix 40, while the output of the other amplifier 76 is fed over another channel output line 82 to provide pan right signals to the combining matrix 40.

Pan left is accomplished by increasing the pan right control voltage 80 to decrease the gain of the pan right amplifier 76. Pan right is accomplished in an opposite manner, i.e., by increasing the pan left control voltage 78 to decrease the gain of the pan left amplifier 74. Pan width is adjusted by making simultaneous and substantially identical adjustments in both of the pan control voltages 78 and 80. A simultaneous increase in the pan control voltages 78 and 80 decreases the ratio of pan signals mixed with mono summation signals in the combining matrix 40 and thus decreases the width of the pans. A simultaneous decrease in the pan control voltages 78 and 80 increases the width of the pans.

The channel output lines 54, 71, 73, 81 and 82 for each channel of the audio processing unit feed their respective signals into input terminals of the combining matrix 40. Referring to FIGS. 2 and 3, the output lines 71 which carry the shorter duration delay signals for each channel and the output lines 81 which carry the pan left signals for each channel are connected to respective matrix input terminals D, E, F, and G, H, I which lead through a first bank of resistors 84 (typically about 10k ohms each) arranged as an active combining network into the inverting input of a first stage operational amplifier 86. The output lines 73 which carry the longer duration delay signals for each channel and the output lines 82 which carry the pan right signals for each channel are connected to respective matrix input terminals J, K, L and M, N, O which lead through a second bank of resistors 88 (typically about 10k ohms each) arranged as an active combining network into the inverting input of another first stage operational amplifier 90. The output lines 54 which carry the channel input signals that are used to generate the mono summation signal 38 are connected to respective matrix input terminals A, B, C which lead through a third bank of resistors 92 (typically about 10k ohms each) arranged as an active combining network into the inverting input of a second stage operational amplifier 94 and through a fourth bank of resistors 96 (typically about 10K ohms each) arranged as an active combining network into the inverting input of another second stage operational amplifier 98. The output line 100 which carries the signal generated by the test oscillator 48 is connected to another matrix terminal P which also leads through the third and fourth banks of resistors 92 and 96 to the inverting inputs of the second stage operational amplifiers 94 and 98. The second stage operational amplifiers 94 and 98 act as the left channel output and the right channel output amplifier, respectively.

The non-inverting outputs of the first stage amplifiers 86 and 90 lead through respective ones of the third and fourth banks of resistors 92 and 96 to the inverting input inputs of respective ones of the second stage operational amplifiers 94 and 98. The inverting outputs of the first stage amplifiers 86 and 90 lead through respective opposite ones of the third and fourth banks of resistors 92 and 96 to the inverting inputs of respective opposite ones of the second stage amplifiers 94 and 98. The non-inverting and inverting outputs of these second stage amplifiers 94 and 98 terminate in conventional XLR connectors (not shown) which provide balanced output lines 102 and 104 (i.e., lines with ground, inverted and in-phase terminals) for the left channel and right channel stereo output signals 42 and 44.

The inverting outputs of the second stage amplifiers 94 and 98 are also connected to the non-inverting inputs of the headphone amplifiers 106 and 108. The non-inverting outputs of these headphone amplifiers 106 and 108 feed the amplified in-phase stereo signals to respective left and right headphone speakers 110 and 112.

A potentiometer 114 in the output line 100 of the test oscillator 48 permits adjustment in the level of the test signal which is passed into the combining matrix 40. A switch 116 in series with the potentiometer 114 is used to selectively connect the test signal to the input terminal P of the matrix 40 or to disconnect the test signal and connect the input terminal P to ground.

The banks of resistors 84, 88, 92 and 96 in the combining matrix 40 perform a summing function. The delay signals and the pan signals are summed by the first and second banks of resistors 84 and 88 and are then fed into the inputs of the respective first stage amplifiers 86 and 90. The resulting amplifier output signals (which have both delay components and dry pan components) are summed with the mono summation signal 38 in the third and fourth banks of resistors 92 and 96 and are then fed into the inputs of the respective second stage amplifiers 94 and 98. The stereo output signals 42 and 44 produced by these second stage amplifiers 94 and 98 thus contain delay components, dry pan components, and dry mono summation components.

It will be appreciated that the left/right panning of sound which is acheived by the circuitry described above results in part from the fact that some portion of the dry pan components is selectively shifted between the left channel stereo output 42 and the right channel output 44. These pan components are essentially the same as the individual mono input signals which are fed into the respective channels of audio processing unit. The pan control amplifiers 74 and 76 in the audio processing channels regulate the magnitudes of the dry monaural signals which are fed into the inputs of the respective first stage amplifiers 86 and 90 of the combining matrix 40. These magnitudes in turn determine the magnitudes of the dry components of the signals which are fed into the inputs of the second stage amplifiers 94 and 98. By adjusting the gains of the pan control amplifiers 74 and 76 in an appropriate manner, the dry components of the input signals can be selectively shifted in varying proportions between the left channel second stage amplifer 94 and the right channel second stage amplifier 98, thereby affecting a change in the left/right spatial location of the sound produced by the stereo output signals 42 and 44 generated at the outputs of the second stage amplifiers 94 and 98.

It will be further appreciated that mono-compatiblility of the stereo output signals 42 and 44 is achieved in part by the fact that the delay components which are present in the left channel stereo output signal 42 are 180° out-of-phase with the delay components which are present in the right channel stereo output signal 44. The delay signals fed into the inputs of the first stage amplifiers 86 and 90 in the combining matrix 40 are distributed to the inputs of the respective second stage amplifiers 94 and 98 in equal magnitudes but in opposite phases. The stereo output signals 42 and 44 which are produced by these second stage amplifiers 94 and 98 thus possess similar out-of-phase relationships between their delay components. When these output signals 42 and 44 are summed together to produce a monaural signal, the out-of-phase delay components cancel each other out. The dry components of the output signals which remain after summation are substantially identical in nature to the original mono signals which were fed into the audio processing unit.

Referring again to FIG. 1, the sound cues used to create the left and right channel signals 42 and 44 are selected and programmed into the system computer 16 by an operator who sits at an operator console 118.

The operator console 118 includes a plurality o dials, toggle switches and push buttons (all not shown) which are mounted on the face of the console 118 and which are manually controlled by the operator. In a preferred embodiment of the invention, the console 118 has one pan control dial and two level control dials for each channel of the audio processing unit, two delay control dials for each of the dialogue and music channels, one pan width control dial for the dialogue channel, one pan width control dial for both the effects and music channels, and one timing dial which controls the length of time the computer waits before sensing a stoppage of dial movement during a CONTINUOUS POT RECORDING function.

The preferred console 118 also includes two toggle switches for each channel which can be used to selectively activate and deactivate the level control dials. By using these switches, the operator can remove a delay effect without losing the setting of the level control dial. Two push buttons are also provided for each channel to select the desired range of delay for the delay units in that channel. Additional dials, switches and buttons may be provided to control additional functions, if desired.

Each of the dials controls a potentiometer (not shown) which is electrically connected to a voltage source (not shown) housed within the operator console 118. The potentiometers, conveniently referred to as "pots", regulate the levels of signal voltage which are passed from the the console 118 over an input line 120 to the input of the system computer 16. The toggle switches are connected in series between the level pots and their respective voltage sources to selectively open and close the circuit therebetween. The push buttons are the previously described range switches which are part of the processor delay units 59 and 60.

In addition to being provided with a plurality of pots, switches and push buttons, the operator console 118 is also provided with a conventional computer keyboard (not shown) which, in the preferred embodiment, is supplied as a part of the computer. The keyboard is used to send operator commands and input data over the input line 120 to the computer 16. A conventional computer monitor 124, such as the Apple G090H, receives display information signals from the computer 16 over a data line 126 and provides the operator with a visual menu of programming options and subroutines and a display of various processor variables and input data.

A detailed description of the manner in which the computer 16 utilize the input signal voltages, the operator commands and the input data to regulate the operation of the audio processing unit will be provided later. Suffice it to say at this stage that the signals, data, add commands are utilized by the computer in conjunction with data and subroutines which are stored in the memory of the computer to produce a plurality of output control voltages (typically 0–5V analog voltages) which are fed over data lines 122 into the audio processing unit. In the audio processing unit, the voltages become the various control voltages 58, 62, 64, 70, 72, 78 and 80 which were previously described and which are applied to the delay units 59 and 60 and the voltage-controlled amplifiers 52, 66, 68, 74, and 76 to regulate the perforaance of the audio processing channels.

As previously noted, the preferred embodiment of the invention utilizes only one pan pot for each channel of the audio processing unit. The computer input signals which are produced by the settings of these pots result in both a pan left control voltage 78 and a pan right control voltage 80. Any change in the setting of the pan pot produces an increase in the control voltage which is applied to one of the pan amplifiers 74 and 76. This results in a well focused, symmetrical and highly directional left/right movement of the sound due to the fact that the combining matrix 40 sends to the left and right channels of the stereo output 42 and 44 equal magnitudes but opposite polarities of the mono signal to be recombined with the original mono signal. It also reduces the amount of information which must be processed and stored by the computer 16 and allows the operator to achieve one-hand control over both left and right pan movements.

The settings of the two level pots for each channel of the audio processing unit produce computer input signals which result in the delay amplitude control voltages 70 and 72 which are applied to the level control amplifiers 66 for the shorter duration delay units 59 and the level control amplifiers 68 for the longer duration delay units 60, respectively. These pots thus control the amplitude of the delayed signals which are mixed with the dry signals in the combining matrix 40, acoustically expanding the sound to a wider field or contracting it to a narrower field.

The settings of the two delay pots for the dialogue channel and the two delay pots for the effects channel produce computer input signals which result in the delay time control voltages 62 and 64 for their respective channels. One of the delay pots for each channel regulates the control voltage 62 applied to the shorter duration delay unit 59, while the other of the delay pots for that channel regulates the control voltage 64 applied to the longer duration unit 60. The delay pots thus control the length of the delay which is mixed with the mono in the combining matrix 40.

Like the dialogue channel pan pot, the settings of the pan width control pot for the dialogue channel (conveniently referred to as the "Wild" pot) produce computer input signals which result in both a pan left control voltage 78 and a pan right control voltage 80 in the dialogue channel. However, unlike the pan pot, a change in the setting of the Wild pot produces substantially simultaneous and identical changes in the pan control voltages 78 and 80. It thus controls the width of the dialogue pans.

The setting of the single pan width control for the effects channel and the music channel produces computer input signals which result in both a pan left control voltage 78 and a pan right control voltage 80 in both channels. Like the Wild pot, any change in the setting of this pan width control pot produces substantially simultaneous and identical changes in the pan control voltages 78 and 80 for each channel. It thus has the same effect on the pan widths of the effects and music channels as the Wild pot has on the pan width of the dialogue channel.

The setting of the timing pot has no direct effect on the audio signal. The computer input signal produced by the settings of this pot establish a waiting time value which is used by the computer during a CONTINUOUS POT RECORDING function. The details of that funtion will be described later.

In the recording mode of operation, the operator plays the working cassette on the VCR 10 and watches the video program which is displayed on the television monitor 12. He uses the shuttle control to step through the program as desired.

As he watches the program, he manually adjusts the controls on the operator console 18 in order to obtain acoustical effects which best match the scene he is watching. In the recording mode, any change in the settings of the pots or switches have an immediate effect on the control voltages which are applied to the audio processing unit. The audio portion of the program being played by the VCR 10 is thus processed in real time by the audio processing unit in a manner which reflects the instantaneous settings of the console controls. The operator adjusts the console controls until he obtains the desired sounds from speakers which are driven by the stereo output signals 42 and 44.

When the appropriate settings are obtained, the operator uses the keyboard to command the computer 16 to formulate and store appropriate sound cues. In simple terms, a sound cue is a data entry stored in the memory of the computer 16 which matches the input signals produced by the settings on the operator console 118 with the corresponding video time codes being displayed in the code display region 14 of the television monitor 12. A time code reader 128 is used to read the time codes rrom the working cassette and send a corresponding time code signal over an input line 130 to the computer 16. The sound cues thus synchronize the appropriate portions of the video program with the acoustical effects which were selected by the operator.

In the playback mode of operation, the working cassette is replaced by the master videotape element and by the conformed original sound elements 132, 134 and 136. A synchronizer 138 communicates with the time code reader 128 and a playback device for the sound elements 132, 134 and 136 over sync lines 140–146 in order to synchronize the videotape with the sound elements 132, 134 and 136.

While the VCR 10 plays the videotape in real time, the corresponding time codes are sent to the computer 16 over the input line 130. The computer 16 continuously compares these time codes with the time codes for the sound cues which are stored in memory, and when a time code match is obtained, the computer 16 automatically generates on the data lines 122 the control voltages which correspond to that sound cue. These control voltages regulate the audio processing unit in a manner which achieves real-time processing of the monaural input signals received from the sound elements 132–136. The stereo output signals 42 and 44 from the audio processing unit thus produce real-time stereo sound which is synchronized with the videotape and which recreates the acoustical effects programmed by the operator.

After the sound cues have been entered, the audio processing unit can be used as a playback device to provide stereo sound from the original monaural sound elements or it can be used as a post-production device to create a recorded stereo sound track. To record a stereo sound track, the stereo output signals 42 and 44 which are produced by the audio processing unit during the playback mode of operation are recorded onto a digital two track audiotape (not shown) and the tracks are then subsequently laid back on to the videotape master.

Figure 4:
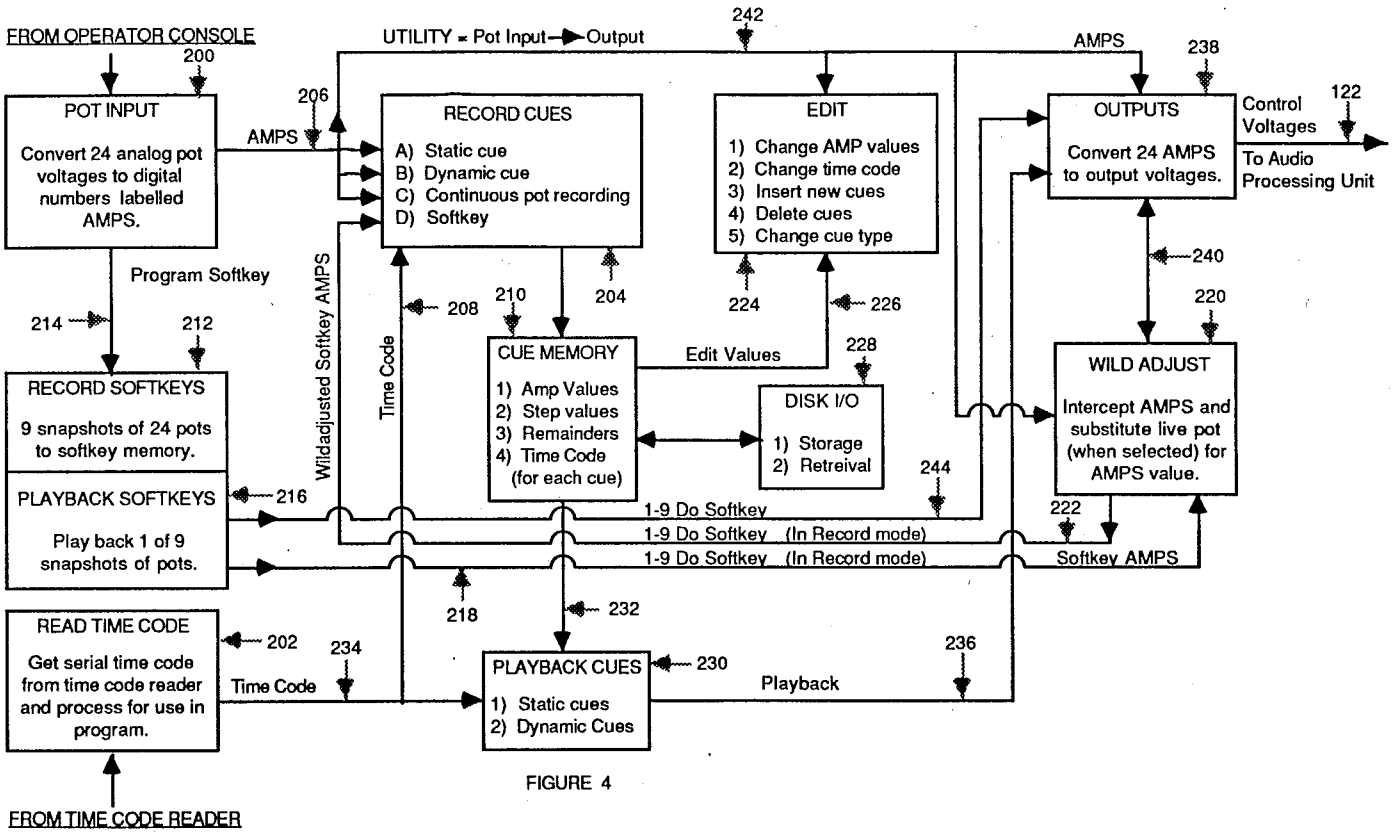
FIG. 4 is a functional block diagram for a cue control processing system utilized by the synthesizer of FIG. 1.

The operation of the programmed computer 16 is best understood by reference to FIG. 4.

The sixteen analog input signal voltages produced by the settings of the sixteen console pots are fed into the computer 16 over the input line 120. A POT INPUT function 200 utilizes a plurality of conventional analog-to-ditigal converters (not shown) to convert the analog voltages into respective digital signals (denominated "amps"). The corresponding video time codes which are read by the time code reader 128 are fed into the computer 16 over the input line 130 where they are converted into digital time code signals by a READ TIME CODE function 202. In a preferred embodiment of the invention, an Apple Super Serial Card is used in an extension slot of the preferred Apple II GS computer to convert the serial data from the time code reader 128 into parallel data used by the computer.

In a RECORD CUES mode of operation 204, the computer utilizes the amps signals received over a line 206 and the digital time code signals received over a line 208 to formulate the sound cues which represent the acoustical effects selected by the operator. Each sound cue generally consists of the amps signals for the desired acoustical effects matched with the time code signal for the corresponding scene in the video program. The sound cues are recorded and stored in a cue memory 210. A cue counter (not shown) assigns a different cue number to each stored cue in order to keep the cues in their proper sequence. There are four specific types of sound cues which can be selected by the operator.

A STATIC cue is used for frame-by-frame cuing or to make instantaneous cuts from one cue to another cue. When played back, a STATIC cue cuts immediately to the stored cue value when the time code signal reaches or exceeds the associated time code stored for that cue.

A DYNAMIC cue subroutine is used to perform a dynamic cut, i.e., a smooth, linear move to the stored cue from a previous que. To make a DYNAMIC, a STATIC cue is recorded where the dynamic is to start. The pots and the video tape are then moved and a DYNAMIC cue is recorded where the dynamic is to stop. An advantage of the dynamic cue is that it obviates the need for the operator to record a separate cue for each video frame covered by the dynamic cut. DYNAMIC cues can be stacked for continuous movement.

When recording either a STATIC cue or a DYNAMIC cue, a computer subroutine determines the differences in the pot settings and the differences in the time codes between the new cue and the previous cue and calculates the stepping increment which is needed to move the pots from the previous cues settings to the new cue settings in the time period covered by the corresponding video program. Two values called the Step and the Remainder are computed to indicate the amount which the pots settings must change at each successive video frame and the amount of change remaining to be made before the new pot settings are reached. For each cue, the Step and Remainder values are stored in the cue memory 210 along with the final amps values and the final time code value for the cue. A static or dynamic flag ("S" or "D") is also stored with the cue to differentiate between STATIC cues and DYNAMIC cues in the playback mode of operation.

A CONTINUOUS POT RECORDING subroutine is used for making a real-time pot movement and recording it substantially the same as it was done. The computer monitors the real-time movement of the pots and records a cue each time movement stops. The instantaneous amp value at each stoppage is automatically matched with the corresponding time code to produce a continuous sequence of cues which are stored in the cue memory 210. On playback, the cues are automatically recalled in sequence when the corresponding time code values are reached, thereby recreating the audio effect of continuous pot movements in real time. This type of cue recording is generally faster than STATIC or DYNAMIC cue recording and is particularly useful where the scene being recorded calls for relatively slow audio changes.

The setting of the timing pot is not recorded during CONTINUOUS PO RECORDING but is used to determine how long the computer waits after the pots stop moving before recognizing that a stoppage has occurred. The shorter the delay, the faster the computer reacts, leading to more cues being recorded in a given time period and resulting in increased accuracy of tracking during CONTINUOUS POT RECORDING.

A SOFTKEY subroutine automatically puts into the cue memory 210 a cue which represents a pre-recorded setting (called a "softkey") for each of the sixteen pots. The cue counter is automatically incremented by one each time a softkey is placed into the cue memory 210.

Softkeys are programmed by a RECORD SOFTKEYS function 212 which takes input amps values over a line 214 and stores them in a softkey memory (not shown). The stored amps values represent a snapshot of the instantaneous settings of each of the sixteen pots. Up to nine such snapshots can be stored in the softkey memory.

For SOFTKEY cue recording, a PLAYBACK SOFTKEYS function 216 is used to selectively recall one of the stored snapshots from the softkey memory and pass the corresponding softkey amps values over a line 218 to a WILD ADJUST function 220. If the WILD ADJUST function 220 has been activated by the operator, the softkey amps values will be intercepted and an amps value indicative of a live pot setting will be substituted. WILD ADJUST 220 can be used to override all or only selected ones of the SOFTKEY amps values. The latter feature is useful where, for example, the softkey setting is desired for a single pan position but live control is desired for the other positions. The softkey amps values as modified by the WILD ADJUST 220 are then passed over a line 222 to the RECORD CUES function 204 where they are matched with the instantaneous time code value and stored as a cue in the cue memory 210.

Cues stored in the cue memory 210 can be modified by use of an EDIT function 224.

In the editing mode, any of the stored pot amps values can be selected for change. Once a value is selected, it is temporarly pulled from memory over a line 226 and the corresponding pot becomes live. Turning the pot changes the amps value. The changed amps value is then stored in the cue memory 210 in place of the original amps value.

Stored time codes can also be pulled from memory and changed in the editing mode. The time code for a selected cue can be incremented or decremented frame-by-frame or second-by-second.

A new cue can be inserted prior to a stored cue. The videotape is moved to the position where the new cue is desired. The time code value for the position (which preferably is less than the time code value for the stored cue and greater than the time code value for the cue previous to the stored cue) is then matched with the amps values for the cue previous to the stored cue to create a new cue which is stored in the cue memory 210 at the cue count immediately preceding the count of the original stored cue.

A stored cue can be deleted from the cue memory 210. In the preferred embodiment of the invention, the time code and amps values for a cue pulled from memory are temporarily stored in a buffer (not shown) so that they may be selectively placed back into the cue memory 210 at a different cue count position. The new position is preferably selected so that the time code of the relocated cue is between the time code of the previous cue and the time code of the next cue at the new location.

A stored cue can also be changed from a STATIC type cue to a DYNAMIC type cue, or visa versa. A simple way to change the cue type is change the flag which is stored with the cue. This approach is generally sufficient for changing a DYNAMIC cue to a STATIC cue, but an additional step is often used when changing a STATIC cue to a DYNAMIC cue. The videotape is placed several frames earlier than the time code of the instant stored cue and several frames later than the time code of the previous stored cue. A new STATIC cue is then placed into the cue memory 210 between the instant stored cue and the previous stored cue. The new cue is given the time code of the current position of the videotape and is given amps values which are copied from the previous stored cue. This technique softens the abrupt change to the instant stored cue by providing a DYNAMIC ramp to that cue.

A DISK I/O function 228 is used to save cues loaded in the cue memory 210 by storing them onto a floppy disk (not shown) and to retrieve cues saved on floppy disk and load them into the cue memory 210. Softkeys can be loaded from and saved to floppy disk by using the DISK I/O function 228 in a similar manner.

In the playback mode of operation, the cues which have been stored in the cue memory cue 10 are automatically recalled at the appropriate time during the video program and are used to regulate the audio processing unit as previously described.

A PLAYBACK CUES function 230 recalls a cue from the cue memory 210 over a line 232 when the corresponding time code for that cue is received from the READ TIME CODE function 202 over a line 234. The PLAYBACK CUES function 230 reads the flag stored with the cue to differentiate between STATIC cues and DYNAMIC cues.

The recalled cue is directed over a line 236 to an OUTPUT function 238 which includes a plurality of conventional digital-to-analog converters (not shown). The OUTPUT function 238 converts the digital amps signals for each of the pot settings stored in the cue to a corresponding analog output signal. The analog signals are passed over the data line 122 where they are used as the control voltages which regulate the various voltage-controlled amplifiers and delay units in the audio processing unit.

The progression of time codes which is read by the READ TIME CODE function 202 during playback causes the PLAYBACK CUES function 230 to recall the stored cues in the desired sequence and at the desired time during the video program. This produces a sequence of changes in the control voltages which simulates the sequence of changes in pot settings which were programmed by the operator during recording. The audio processing unit responds to these changes in control voltages to alter the monaural audio input signal in real time in a manner which produces the desired acoustical effects.

It will be appreciated that the pots do not physically turn when the control voltages are changed by the sequence of recalled cues during playback. However, the resulting acoustical effects produced by the control voltages are substantially the same as if the pots were being physically turned by an operator acting in real time.

The WILD ADJUST function 220 discussed earlier can be used to cause selected pots to be "live" during playback. Any one or more of the pots can be selected, while any unselected pots will remain automated from the cue memory 210. Acting over a line 240, WILD ADJUST 220 will intercept the amps values for the selected pots and will substitute the amps values which are dictated by the live settings by the selected pots.

System testing is accomplished by a UTILITY function which reads all of the live pot settings and outputs them directly to the audio processing unit for listening, testing and alignment. UTILITY is the default routine which is entered automatically upon start-up of the system.

In UTILITY, the amps values on the line 206 which represent the live pot settings are passed directly to the OUTPUT function 238 over a line 242. The control voltages thus represent the instantaneous pot settings and any adjustment in a pot setting will produce an immediate and corresponding change in the control voltage and in the acoustical effects produced by the audio processing unit. Similar testing of the softkeys is accomplished in UTILITY by passing the selected softkey snapshots over a line 244 directly to the OUTPUT function 238.

A sample of a computer program (in object code) which can be used with the preferred apparatus for carrying out the features of the present invention is attached hereto as an appendix and the entirety of that program is incorporated herein by reference.

B. Preferred Methods Of Use

In addition to providing apparatus which converts a monaural audio signal into a stereo surround signal, the present invention is also concerned with various techniques for creating desired acoustica effects. While the techniques will be described wtth reference to the preferred apparatus of the present invention, it will be appreciated that the techniques can be carried out using any suitable equipment.

With a multi-track DME source, dialogue panning is achieved by adjusting the pan pot for the dialogue channel of the audio processing unit. With a composite monaural source, the same pan pot controls the left and right placement of the composite monaural sound. The Wild pot is used to control the pan width, i.e. the maximum range of left and right movement.

When there are background sounds behind the dialogue as is often the case with composite tracks, mere dialogue panning may produce undesirable results. The background sounds will tend to move with the panned dialogue. This problem can be minimized by increasing the settings of the dialogue level pots to spread the dialogue out over a wider sound field.

Dialogue proximity is controlled by the delay pots and the level pots. As a speaking actor moves toward the camera, a sense of approach can be created by decreasing the settings of the dialogue delay pots. This creates a doppler effect which enhances the approach proximity information already recorded on the sound track when the actor moved forward. The effect works equally well in reverse for the case of an actor moving away from the camera. It may desirable to avoid this effect when there are background sounds on the track because the movement of the background may produce undesirable results.

As the actor moves forward, an increase in the settings of the dialogue level pots will emphasize the effect. As he recedes, the level pots should be decreased. Simultaneous use of the delay and the level pots is an effective technique for achieving realistic near/far placement.

Dialogue ambience is also controlled by the delay pots and the level pots. A short duration delay is used to simulate a small to medium size room. For example, a delay of about 8 ms. can create the effect of a medium size room whereas a delay of about 2 ms. can create the effect of a room the size of a telephone booth or the interior of a car. Longer duration delays in the range about 8–32 ms can simulate medium rooms to large halls.

The level pots can be used to make the room size more pronounced. An increased level setting can create the effect of a hard walled room with many reflective surfaces while a decreased level setting can create the effect of a soft padded room.

Dialogue movement can be achieved by any of several cut or slide techniques.

There are at least three ways to move an envelope to an actor when he speaks. The first is to cut to the actor on the frame where he starts speaking. The second is to start panning to him as soon as the previous actor finishes. The third is to insert a dynamic start about seven to ten frames before the actor starts speaking in a new position.

The choice among the three methods depends on background ambience. If ambience is low and the actor speaks loud and clear, cuts work well. If cuts are too noticeable, the panning technique can be used. The disadvantage of panning is in short pans. If the pan is only a second or two, the audience may hear the background panning. Longer pans are more effective. The dynamic start tecnnique provides an effective compromise. It is essentially a soft cut to the actor a few frames before he speaks.

Problems may arise when an actor talks while his screen image cuts abruptly. It may be difficult to maintain the integrity of the positioning while avoiding a break in the narrative flow. Two techniques for approaching the problem are to reduce the pan width so that the cuts become less abrupt or to cut between two words near the visual cut rather than on the visual cut if the cut falls mid-word.

Dialogue overlaps can be handled with the pan pot and the level pots. If one actor interrupts another, there will be a point where the new actor (the interrupter) is talking louder then the old actor (the interruptee). When the new actor starts the interrupt, begin a pan to him. When he is fully dominant or the old actor stops talking, finish the pan. Once the audience has identified with the new actor's dialogue, the sound should be fully positioned on that actor. If the actors are engaged in non-stop simultaneous talking, slightly favor the loudest one. If none of these techniques produce satisfactory results, center the envelope and increase the spread by upwardly adjusting the level pots.

Effects panning is achieved by adjusting the pan pot in the effects channel of the audio processing unit. The pan width control pot controls the width of effects pans.

Effects on the dialogue track of a DME source are often "doubled" on the effects track. A door slam which appears on the dialogue track may not have enough impact when recorded with the dialogue so an emphasized door slam is recorded on the effects track. Likewise, there may be foley work which adds to the normal sounds on the dialogue track. In both of these cases, the dialogue track should be moved with the effects track.

Good stereo opportunities arise when the effects on the effects track are not doubled on the dialogue track. Dog barks, traffic noise, crowds, and the like can be appropriately placed while the dialogue is placed somewhere else.

Effects spreading can be achieved with the level pots and the delay pots in the effects channel.

Spread on the effects gives them liveliness. The level pot for short duration delay can be used to spread the effects a little wider than the dialogue. The level pot for medium duration delay is increased to obtain a long spread for helicopters, distance, gun battle ambience, and general shock value. A simultaneous increase in the duration of the medium delay will often cause the effects to show up in the surround channel. This can be used for overwhelming effects like car crashes, wars, bombs, and the like.

The level pots and the delay pots can also be used to create proximity effects. For example, in a drag racing scene where two cars are starting up (revving engines, squealing tires, etc.) just behind the camera point of view, the level may be increased to spread the sound while the delay is decreased to create the sense of close proximity. As the cars speed off to the vanishing point (i.e., center screen in the distance), the desired effect of cars heading off into the distance can be achieved by dynamically decreasing the level while increasing the delay for doppler. Helicopters can benefit from a similiar sound treatment. Short duration delay and high level will create the desired noisy wide sound when the helicopter is close up, while a receding effect is obtained by decreasing the level and increasing the duration of the delay.

Left-right positioning and panning of effects is achieved by using the pan pot as described above. Movement on an axis toward or away from the camera is achieved by use of the level pots and the delay pots. For example, when a vehicle approaches the camera, a dynamic increaee in the level accompanied by a dynamic decrease in the duration of the delay will create the sound of approaching doppler. As the vehicle recedes, an increase in the duration of the delay along with a decrease in the level will create a receding doppler and a narrowing of the sound appropriate to the visual narrowing of the vehicle as it recedes.

In the case of a vehicle which approaches from screen left in the distance, gets closer at about midscreen, and then moves off to the right, a simple pan can be used to follow the car from its start to its end position. However, a more accurate way to follow the action would be to initially set the pan pot to the proper start position, set the short duration delay pot to the longest duration and set the short delay level pot to slightly less the maximum. As the car moves, make a track of its movements by connecting dots. When it comes straight forward, decrease the delay and increase the level. When it turns to the right and continues to approach, adjust the pan, the delay and the level simultaneously.

For a gun battle, each shot can be placed at the gun barrel when it is fired. The sound can then be moved across the sound field to the locations where the bullet hits and ricochets.

Effects which are not location specific should be balanced off-screen left and off-screen right. Balancing the effects around the center-screen over time enhances the impact of a quick placement of an effect off to the side.

Surround is generally perceivable when the level setting equals or exceeds the mono amplitude. More surround is perceived when the delay is long enough to be separated from the mono in time. Accordingly, transient sounds will be decoded as surround if given sufficient level and delay. Steady sounds, such as sirens, will not be in the surround as much as the transients. As a general rule, surround can be triggered by turning the medium delay level pot and the medium delay pot to their maximum settings.

Music panning is achieved by adjusting the pan pot in the music channel of audio processing unit. Music panning is used to pan the music from a radio, television or live band to the appropriate location on the screen. It is also useful for placing lead instruments or vocalists in an on-screen performance. The pan width control pot controls the width of music pans.

Where dialogue or effects are present on the music track, the music pan pot can be used to place the sound appropriately, but the music level pot for long delays is preferably reduced to prevent unnatural doubling of the sound.

The techniques described above for dialogue and effects are generally applicable to a composite mono signal if proper cue placements are used.

The pot setup for using the dialogue channel with a composite mono source is generally the same as when it is used with a DME source except that longer duration delay is generally given a higher range (e.g., a range of about 32–128 ms). These longer delays are used mostly for music and effects and will be turned off most of the time.

A consideration with composite mono is how to move one sound without perceptibly moving another, especially if the other sound is background ambience. To pan convincingly with high background ambience, the setting of the short delay level pot is turned up until the scope trace approximates the shape of a fat cigar. This causes the pans to be somewhat hidden by the spread so that there will be little or no perception of movement in the background ambience. The short duration delay pot setting should be kept low enough so that no dialogue doubling is perceived.

Psychoacoustically, the ear senses the pan only on the loudest sound in the track. For example, the lead instrument or vocalist in a band usually can be panned without perceptibly moving the whole band. If a pan causes undesirable background movement, the problem can be solved by panning less or by turning up the spread through adjustment of the short delay level pot.

When the track contains music only, the long delay level pot can be turned up to let the music spread out. If dialogue or a solo vocal comes on while at a high setting of the long delay level pot, a dynamic can be used to bring down the level and avoid the effect of having the dialogue or vocal sound as if it was coming from within a chamber.

A cut to wide music spread on a down beat is an effective technique. When the music ends, the long delay level can be brought down as the applause (if any) dies. An increase in the long delay level can be used to put transients like cymbals and drum rimshots into the surround channel.

A common difficultly with a composite mono source is achieving a proper balance between accurate placement of sound and compromise. For example, if there is a war background and two actors in the foreround are speaking on different sides of the screen, it is not always practical to move the dialogue without also moving the center of the war. Similarly, if the long delay level pot setting has been turned up to make the war exciting, it can not always be decreased enough to make an actor sound natural. The usual solution is to compromise the level of the war and accept a slight unnaturalness in the voices. This allows the war to remain spread out somewhat, yet also allows the level to be brought down less drastically when the actors speak.

Various editing problems can also arise when dealing with composite mono tracks.

As a general rule, if the sound to be located is long enough and loud enough, it can be placed by cuts without causing noticeable movement in background sounds. For example, where two people are talking loudly across a table while a band is playing softly in the background, it is possible to cut back-and-forth and follow the dialogue with no perceptible shifting in the location of the background music.

When an actor is talking with only film noise for ambience (as often happens with optical sound tracks) and a cut is made to the side of the screen to pick up an effect, it is usually better to remain at that position and cut back only when the actor starts talking again. Hearing a hiss envelope move over and then cut back while waiting for the actor is an unnatural effect. A slow pan back to the actor is often preferable. Most pans of film noise which last longer than about three seconds can be hidden fairly well psychoacoustically.

If a recorded cut sounds too abrupt when repeated on playback, the EDIT function can be used to insert a dynamic and soften the cut.

From the foregoing it will be appreciated that the automated stereo synthesizer method and apparatus of the present invention produces realistic stereo with surround from the monaural audio tracks of audiovisual programs, resulting in enhanced audio quality for older movies and television programs and reducing the expense and technical difficulty of creating surround stereo sound tracks. The stereo signals are steerable and compatible with existing monaural audio equipment. A wide variety of acoustical effects and sound placements can be achieved and these are utilized to create an audio program which matches the video program. Time codes and sound cues are used to synchronize the programs and to achieve operator control over the resulting stereo sound.

While particular forms of the invention have been illustrated and described, it will be apparent that various modifications can be made without departing from the spirit and scope of the invention. Accordingly, it is not intended that the invention be limited, except as by the appended claims.

What is claimed is:

1. Automated stereo syntheziser apparatus for use with monaural audiovisual programs, comprising:

audio playback means for producing monaural audio signals from an audio portion of a monaural audiovisual program;

audio processing means for converting said monaural audio signals into stereo audio signals in response to control signals;

video code means for generating video code signals correlated with a video portion of said audiovisual program; and control means responsive to said video code signals for generating said control signals which regulate the audio processing unit, whereby said stereo audio signals produced by said audio processing means are synchronized with said video portion of said audiovisual program.

2. Apparatus as set forth in claim 1, wherein said audio processing means distributes said stereo audio signals among plural audio channels and further comprises pan control means responsive to said control signals for distributing said monaural audio signals among said audio channels in a selectively variable manner.

3. Apparatus as set forth in claim 1, wherein said audio processing means comprises delay control means responsive to said control signals for introducing time delay into said monaural audio signals and thereby generating delayed audio signals.

4. Apparatus as set forth in claim 3, wherein said audio processing means further comprises level control means responsive to said control signals for regulating the amplitude of said delayed audio signals.

5. Apparatus as set forth in claim 4, wherein said audio processing means further comprises combining matrix means for combining said delayed audio signals with said monaual audio signals in a ratio determined by said level control means.

6. Apparatus as set forth in claim 5, wherein said audio processing means further comprises pan control means responsive to said control signals for producing pan control signals, said combining matrix means combining said pan control signals with said delayed audio signals and said monaural audio signals to generate said stereo audio signals which are distributed among plural audio channels in a manner responsive to said pan control signals.

7. Apparatus as set forth in claim 6, wherein said combining matrix distributes said delayed audio signals among said plural audio channels in an out-of-phase relationship whereby said delayed audio signals cancel each other out upon summation of said audio channels.

8. Apparatus as set forth in claim 6, wherein said delay control means comprise voltage-controlled digital delay units and said pan control mean and said level control means comprise voltage-controlled amplifiers.

9. Apparatus as set forth in claim 6, wherein said combining matrix means comprises first stage amplifiers having inverting and non-inverting outputs and second stage amplifiers having identical inputs, said inverting outputs from each of said first stage amplifiers being in communication with said inputs of respective ones of said second stage amplifiers and said non-inverting outputs from each of said first stage amplifiers being in communication with said inputs of different respective ones of said second stage amplifiers.

10. Apparatus as set forth in claim 1, further comprising operator input means in communication with said control means for generating user selected input signals which regulate said control signals.

11. Apparatus as set forth in claim 2, further comprising operator input means for generating user selected pan input signals which regulate said control signals in a manner whereby the amplitudes of said monaural audio signals distributed among said audio channels are simultaneously varied by substantially equal magnitudes but opposite polarities.

12. Apparatus as set forth in claim 10, wherein said operator input means comprise dynamic input means for generating dynamic signals which automatically produce a continuous linear transition between a first selected one of said user input signals and a second selected one of said user input signals during a period between selected video code signals.

13. Apparatus as set forth in claim 10, wherein said operator input means comprises continuous recording means for automatically generating said user selected input signals in response to changes in movement of a control device 14. Apparatus as set forth in claim 10, wherein said operator input means comprise means for selecting said user input signals from a plurality of predetermined user input signals.

15. Apparatus as set forth in claim 10, wherein said control means comprise storage means for storing said user selected input signals over time.

16. Apparatus as set forth in claim 15, wherein said operator input means comprise edit means for selectively altering said user selected input signals stored in said storage means.

17. Apparatus as set forth in claim 15, wherein said control means further comprise playback means for automatically recalling said user selected input signals from said storage means in response to said video code signals.

18. Apparatus as set forth in claim 17, wherein said operator input means comprise intercept means for intercepting said user selected input signals recalled from said storage means and substituting therefor another of said user selected input signals generated by said operator input means.

19. Apparatus as set forth in claim 1, wherein said audio processing means comprise delay means for introducing time delay into said stereo audio signals and matrix means for distributing said stereo audio signals among a plurality of audio channels in a manner whereby said time delay in said stereo audio signals in respective ones of said audio channels are out-of-phase with each other.

20. Apparatus as set forth in claim 1, wherein said audiovisual program has a composite monaural sound track.

21. Apparatus as set forth in claim 1, wherein said audiovisual program has multiple monaural sound tracks.

22. Apparatus as set forth in claim 10, wherein said operator input means comprise cue forming means for correlating said user selected input signals with said video code signals.

23. Apparatus as set forth in claim 22, wherein said control means comprise storage means for storing said user selected input signals and further comprises playback means for automatically recalling said user selected input signals from said storage means in response to said video code means generating said correlated video code signals.

24. Apparatus as set forth in claim 1, further comprising stereo recording means for recording said stereo audio signals onto an audio track for an audiovisual program.

25. Apparatus as set forth in claim 3, wherein said delay means comprises first delay means for introducing a delay of first duration into said monaural audio signals and second delay means for introducing a delay of second duration into said monaural audio signals.

26. Apparatus as set forth in claim 1, wherein said video code signals comprise SMPTE time code.

27. Method for generating stereo sound from a monaural audiovisual program, comprising:

reading a monaural sound track from a monaural audiovisual program to generate monaural sound signals;

assigning video codes correlated with a video portion of said audiovisual program; and processing said monaural audio signals with a stereo synthesizer responsive to said video codes to generate stereo audio signals from said synthesizer which are synchronized with said video portion of said audiovisual program.

28. A method as set forth in claim 27, further comprising distributing said stereo audio signals among plural audio channels in a selectively variable manner.

29. A method as set forth in claim 27, further comprising delaying said monaural audio signals to produce delayed audio signals.

30. A method as set forth in claim 29, further comprising regulating the amplitude of said delayed audio signals.

31. A method as set forth in claim 29, further comprising combining said delayed audio signals with said monaural audio signals.

32. A method as set forth in claim 29, further comprising distributing said delayed audio signals among plural audio channels and altering the phases of said delayed audio signals whereby they cancel each other out upon summation of said audio channels.

33. A method is set forth in claim 27, further comprising regulating said processing of said monaural audio signals in response to user selected inputs.

34. A method as set forth in claim 33, further comprising forming sound cues which correlate said user selected inputs with said video codes.

35. A method as set forth in claim 34, further comprising processing said monaural audio signals in accordance with said user selected inputs when said video codes from said video portion of said audiovisual program match said video codes correlated with said user selected inputs.

36. A method for generating stereo sound from a monaural audiovisual program, comprising:

playing a monaural sound track from a monaural audiovisual program;

assigning video codes correlated with a video portion of said audiovisual program; and processing said monaural sound with a stereo synthesizer responsive to said video codes in order to generate stereo sound which is synchronized with said video portion of said audiovisual program.

37. A method as set forth in claim 36, wherein said processing comprises spreading said monaural sound over a relatively wide audio field and panning said spread sound across said field to track movements by elements in said video portion of said audiovisual program which correspond to said monaural sounds.

38. A method as set forth in claim 36, wherein said processing comprises altering resonance and spread in said monaural sound to track proximity movements by elements in said video portion of said audiovisual program which correspond to said monaural sound.

39. A method as set forth in claim 36, wherein said processing comprises altering resonance and spread in said monaural sound to correlate said sound with ambience depicted in said video portion of said audiovisual program.

40. A method as set forth in claim 36, wherein said processing comprises panning said monaural sound across a sound field in a gradual manner to track abrupt changes in said video portion of said audiovisual program which correspond to said monaural sound.

41. A method as set forth in claim 36, wherein said processing comprises altering spread in said monaural sound in a gradual manner to track abrupt changes in said video portion of said audiovisual program which correspond to said monaural sound.

* * * * *